US005646481A

United States Patent [19]

Zovko

[11] Patent Number: 5,646,481

[45] Date of Patent: Jul. 8, 1997

[54] EL LAMP WITH COLOR MATCHING OR HIDDEN GRAPHIC

[76] Inventor: Charles I. Zovko, 2105 N. Salida del Sol, Chandler, Ariz. 85224

[21] Appl. No.: 552,809

[22] Filed: Nov. 3, 1995

[51] Int. Cl.[6] ..... H01J 1/62

[52] U.S. Cl. ..... 313/510; 313/509; 313/506; 40/544

[58] Field of Search ..... 313/110, 117, 313/506, 507, 509, 510, 513; 40/541–542, 544, 615, 550; 315/169.3; 428/690, 917

[56] References Cited

U.S. PATENT DOCUMENTS

| | | | |
|---|---|---|---|
| 1,362,284 | 12/1920 | Gay | 40/544 |
| 3,027,668 | 4/1962 | Hardesty | 313/510 |
| 3,310,703 | 3/1967 | Brooks | 313/510 |
| 3,368,099 | 2/1968 | Arnold | 313/509 |
| 3,397,334 | 8/1968 | Motson | 313/510 |
| 3,545,110 | 12/1970 | Coolbaugh et al. | 313/510 |
| 3,673,450 | 6/1972 | Leach | 313/510 |
| 3,680,237 | 8/1972 | Finnerty, Sr. | 313/510 |
| 4,603,065 | 7/1986 | Mori et al. | 428/31 |
| 5,009,019 | 4/1991 | Erlendsson et al. | 40/541 |

OTHER PUBLICATIONS

"*A guide to Understanding Color Communication*", published by X–Rite, Incorporated, 1993.

"*A guide to Understanding Color Tolerancing*", published by X–Rite, Incorporated, 1993.

*Primary Examiner*—Sandra L. O'Shea
*Assistant Examiner*—J. M. Patidar
*Attorney, Agent, or Firm*—Paul F. Wille

[57] ABSTRACT

An EL lamp having a transparent front electrode is overprinted with an opaque graphic having the same color as the phosphor in the lamp. A translucent coating over the graphic is clear or tinted. The graphic is visible only when the lamp is lit. In an alternative embodiment of the invention, a second graphic, visible whether or not the lamp is lit, is overprinted on the lamp. The second graphic has a color perceptibly different from the color of the phosphor and is opaque, transparent, or any opacity between opaque and transparent.

9 Claims, 1 Drawing Sheet

EL LAMP WITH COLOR MATCHING OR HIDDEN GRAPHIC

BACKGROUND OF THE INVENTION

This invention relates to an electroluminescent (EL) lamp and, in particular, to an EL lamp displaying a graphics image only when lit.

An EL lamp is essentially a capacitor having a dielectric layer between two conductive electrodes, one of which is transparent. The dielectric layer can include a phosphor powder or there may be a separate layer of phosphor powder adjacent a dielectric layer. The phosphor powder radiates light in the presence of a strong electric field, using very little current. The front electrode is typically a thin, transparent layer of indium tin oxide or indium oxide and the rear electrode is typically a polymer binder, e.g. polyvinylidene fluoride (PVDF), polyester, vinyl, or epoxy, containing conductive particles such as silver or carbon. The front electrode is applied to a polymer film such as polyester or polycarbonate to provide mechanical integrity and support for the other layers.

It is often desired to have an EL lamp produce a graphic image when illuminated, e.g. text, numerals, a corporate logo, or other symbol. A graphic image can be produced by patterning one or both electrodes of the EL lamp, by applying an opaque graphic to an EL lamp ("overprinting"), or by adding a pre-printed, transparent layer to a lamp. A problem with overprinting a lamp is that the graphic is visible even when the lamp is not lit. Many customers for EL lamps want a graphic visible only when the lamp is lit.

A graphic is also visible when the front electrode is patterned, although the graphic may not be obvious. A patterned electrode is more costly than a continuous electrode and the resulting lamp is yet more costly because one must separately power each lamp in a panel in order to have each lamp equally bright. Providing appropriate conductive runs increases the cost of the panel. Patterning the rear electrode typically produces a fuzzy image because the rear electrode is a screen printed conductive ink and is much thicker than the front electrode. The image is also somewhat fuzzy because the "image" of the rear electrode is diffused in the phosphor layer.

It is known in the art to provide displays with images that are concealed when one or more lamps are off. For example, U.S. Pat. 3,362,284 (Gay) discloses incandescent lamps illuminating a small sign in which a first message, written in phosphorescent ink, is hidden behind a screen on which a second message is written. The background of the first message is painted the same color as the phosphorescent ink. When the lamps are lit, the second message is visible. After the lamps are extinguished, the second message is invisible and the phosphorescent glow of the first message is visible temporarily through the screen.

U.S. Pat, 3,397,334 (Motson) discloses a black mask overprinted on an EL lan@having an Inconel front electrode that is deposited on a roughened glass surface. The front electrode is only 50% to 75% transmissive and appears to be black ("of virtually the same depth" as the mask). The mask defines indicia that are visible when the lamp is lit. Aside from the fact that the single color available, black, is unsuited to many applications, e.g. watch faces, only a mask can be used. The mask covers a substantial part of the front electrode, shielding it from light and making the electrode appear black. Further, as described in the patent, the roughened surface of the glass contributes to the apparent color of the front electrode.

In view of the foregoing, it is therefore an object of the invention to provide an EL lamp for displaying a graphic image only when lit.

Another object of the invention is to provide an overprinted EL lamp having a hidden graphic that is revealed only when the lamp is lit.

A further object of the invention is to provide a overprinted EL lamp in which a continuously visible graphic is combined with a graphic visible only when the lamp is lit.

Another object of the invention is to provide an EL lamp of any desired color having a hidden graphic that is revealed only when the lamp is lit.

SUMMARY OF THE INVENTION

The foregoing objects are achieved in this invention in which an EL lamp having a transparent front electrode is overprinted with an opaque graphic having the same color as the phosphor in the lamp. The graphic is visible only when the lamp is lit. In an alternative embodiment of the invention, a second graphic, visible whether or not the lamp is lit, is overprinted on the lamp. The second graphic has a color perceptibly different from the color of the phosphor and is opaque, transparent, or any opacity between opaque and transparent.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
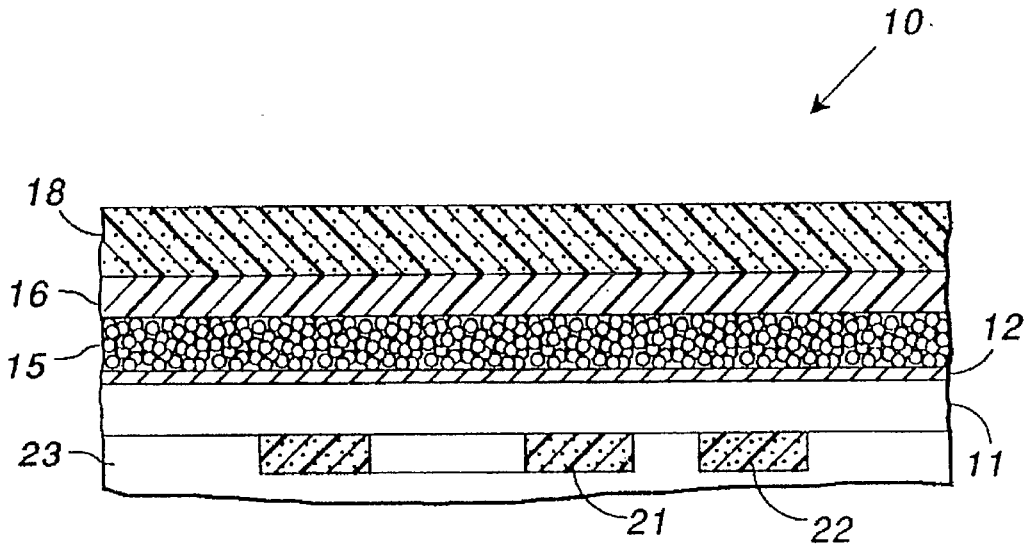
FIG. 1 is a cross-section of an EL lamp constructed in accordance with the invention.

FIG. 1 is a cross-section of an EL lamp constructed in accordance with a preferred embodiment of the invention. Lamp 10 includes transparent substrate 11 of polyester or polycarbonate material. Transparent electrode 12 overlies substrate 11 and includes indium tin oxide or indium oxide. Phosphor layer 15 overlies electrode 12 and dielectric layer 16 overlies the phosphor layer. Rear electrode 18 is a screen printed layer of conductive ink containing conductive particles such as silver or carbon in a resin binder. As described thus far, the construction of lamp 10 is conventional.

Graphic 21, e.g. the letter "O", is printed on substrate 11 using techniques known in the prior art, e.g. by screen printing an opaque ink. In accordance with the invention, graphic 21 has the same color as phosphor layer 15, as seen through electrode 12 and substrate 11, when the phosphor layer is not luminous. Graphic 22, printed before or after graphic 21, is visible whether or not phosphor layer 15 is luminous. That is, graphic 22 is a distinctly different color from phosphor layer 15 and can be opaque or transparent.

After the graphics are applied and cured, lamp 10 is "flood" coated with translucent layer 23, which is clear or tinted to any desired color, e.g. the same color as graphic 21. Layer 23 is cured, completing the lamp except perhaps for cutting the EL panel to a particular shape or size. Lamp 10 shows graphic 21 when lit and hides the graphic when not lit. As used herein, "translucent" does not mean that the graphic is obscured. Translucent means that layer 23 has a matte finish and the graphic is clearly visible through the layer.

Inks in virtually any desired color and opacity are commercially available. An ink suitable for screen printing on an EL lamp includes a resin, such as vinyl acetate, and a pigment. Other resins can be used instead, such as polyesters or acrylics.

An opaque ink preferably includes $TiO_2$ (Litanium dioxide), where the amount of $TiO_2$ determines opacity. A translucent ink differs from an opaque ink by not including $TiO_2$. A resin saturated with $TiO_2$ is, for all practical purposes, opaque. The resin and $TiO_2$ make a white base to which a suitable pigment is added to produce the desired color.

Figure 2:
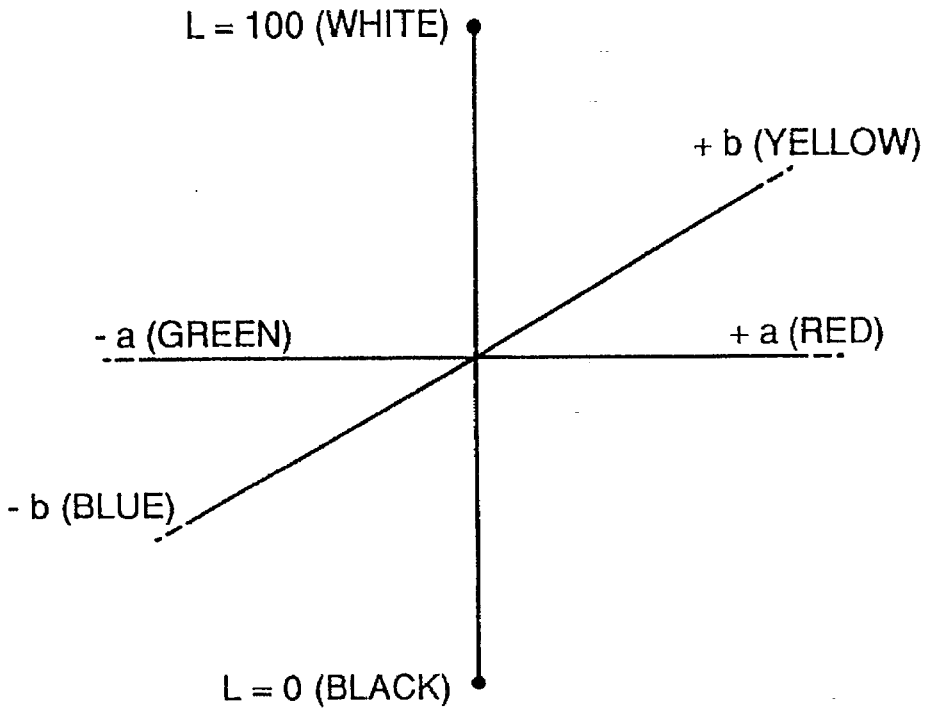
FIG. 2 is a diagram illustrating one system for numerically designating color.

As known in the art, color can be specified in a number of ways. One commercially accepted specification is known as the L*a*b color scale, illustrated in FIG. 2. This scale is based upon the assumption that complementary colors cannot be present simultaneously, i.e. a color cannot be both red and green or cannot be both blue and yellow. In this scale, L defines lightness from L=100 (white) to L=0 (black). The red/green value varies from +a (red) to −a (green) and the yellow/blue value varies from +b (yellow) to -b (blue).

In accordance with the invention, a pigment is specified in accordance with the reflected color of the lamp, i.e. the color of the phosphor layer as seen through the front electrode and through the substrate. This measurement is readily made using a commercially available colorimeter. The unlit lamp and the opaque ink should be the same color but need not have the same color value. As known in the art, small differences in color are imperceptible.

The translucent layer can be clear or tinted to any color. Because of the translucent layer, slightly larger differences in color between the graphic and the lamp can be tolerated. Although inks of almost any color are available, a tolerance for slight differences in colors accommodates possible color shifts that may be caused by the $TiO_2$ filler in an opaque ink having the same pigment and the same resin as a translucent ink. Thus, "same" color does not mean numerically equal color values but means an imperceptible color difference.

The invention thus provides an overprinted EL lamp which can display a graphic image only when lit. A hidden graphic can be combined with a visible graphic to simulate motion or action or simply to provide a more visually interesting display. The lamp is relatively inexpensive to manufacture because continuous layers of phosphor, dielectric, and conductor are used.

Having thus described the invention, it will be apparent to those of skill in the art that various modifications can be made within the scope of the invention. For example, the L*a*b* color specification is not the only one available. The CIE (Commission Internationale de l'Eclairage) chromaticity diagram can be used instead. Although color can be specified in more than one way, it is preferred to choose a color specification system and use it for all colors in a given lamp panel. As known in the art, converting from one specification to another is inexact. In some contexts, "pigment" is interpreted as a dispersion or a suspension of a fine powder in a suitable vehicle, as distingished from a "dye" which is interpreted as a crystalline material dissolved in a suitable vehicle. Either pigments or dyes can be used to implement the invention.

What is claimed as the invention is:

1. An electroluminescent lamp displaying a graphic when lit and hiding said graphic when not lit, said lamp comprising:

a transparent substrate;

a transparent front electrode overlying said substrate;

an electroluminescent layer overlying said front electrode;

an insulating layer overlying said electroluminescent layer;

a rear electrode overlying said insulating layer;

a first opaque graphic on said substrate; wherein the color of said first opaque graphic is the same as the color of said electroluminescent layer as seen through said transparent electrode and said transparent substrate when said electroluminescent layer is not luminous; and said first opaque graphic is visible when said lamp is lit but is not visible when said lamp is not lit.

2. The electroluminescent lamp as set forth in claim 1 and further comprising a translucent coating overlying said first opaque graphic.

3. The electroluminescent lamp as set forth in claim 2 wherein said translucent coating is clear.

4. The electroluminescent lamp as set forth in claim 2 wherein said translucent coating is tinted.

5. The electroluminescent lamp as set forth in claim 1 and further comprising:

a second graphic formed on said substrate; wherein the color of said second graphic is perceptibly different from the color of said electroluminescent layer as seen through said transparent electrode and said transparent substrate when said electroluminescent layer is not luminous; and said second graphic is visible whether or not said lamp is lit.

6. The electroluminescent lamp as set forth in claim 5 and further comprising a translucent coating overlying said first opaque graphic and said second graphic.

7. The electroluminescent lamp as set forth in claim 6 wherein said translucent coating is clear.

8. The electroluminescent lamp as set forth in claim 6 wherein said translucent coating is tinted.

9. The electroluminescent lamp as set forth in claim 5 wherein said second graphic is opaque.

* * * * *